US008544810B2

(12) United States Patent
Watkins et al.

(10) Patent No.: US 8,544,810 B2
(45) Date of Patent: Oct. 1, 2013

(54) CIRCULAR COASTER FOR STEMMED GLASS

(76) Inventors: Michael Watkins, Rochester, NY (US); Dona Watkins, Rochester, NY (US)

( * ) Notice: Subject to any disclaimer, the term of this patent is extended or adjusted under 35 U.S.C. 154(b) by 120 days.

(21) Appl. No.: 13/113,310

(22) Filed: May 23, 2011

(65) Prior Publication Data

US 2011/0284712 A1 Nov. 24, 2011

Related U.S. Application Data

(60) Provisional application No. 61/347,105, filed on May 21, 2010.

(51) Int. Cl.
*A47B 91/00* (2006.01)

(52) U.S. Cl.
USPC ..... 248/346.11; 248/346.01; 248/310; 248/188.1; 220/625; 220/628; 220/630

(58) Field of Classification Search
USPC ..... 248/346.11, 346.01, 310, 188.1; 215/393, 394, 395; 220/495.03, 574, 575, 220/703, 729, 730, 731, 737, 738, 625, 628, 220/630, 632
See application file for complete search history.

(56) References Cited

U.S. PATENT DOCUMENTS

| | | | | | |
|---|---|---|---|---|---|
| 1,037,044 | A | * | 8/1912 | Parkes | 160/231.1 |
| 1,930,415 | A | | 5/1933 | Cantine | |
| 2,035,384 | A | | 11/1934 | Hinchliff | |
| 2,006,238 | A | | 1/1935 | Florman | |
| 1,990,372 | A | * | 2/1935 | Hobart | 215/394 |
| 2,025,963 | A | | 4/1935 | Voelcker | |
| 2,143,045 | A | | 2/1937 | Wicks | |
| 2,343,287 | A | * | 3/1944 | Elsaesser | 215/394 |
| D493,676 | S | | 8/2004 | Cohen | |
| 6,877,705 | B2 | * | 4/2005 | Dauer | 248/346.11 |
| D522,815 | S | | 6/2006 | Garrard | |
| D528,372 | S | | 9/2006 | Garrard | |
| D528,373 | S | | 9/2006 | Garrard | |
| D535,156 | S | | 1/2007 | Leahy | |
| D541,597 | S | | 5/2007 | Garrard | |
| D605,893 | S | | 12/2009 | Reid | |
| D624,790 | S | * | 10/2010 | Wray et al. | D7/624.1 |
| 2008/0128435 | A1 | * | 6/2008 | Hester et al. | 220/630 |

OTHER PUBLICATIONS www.gotmartini.com; "Flip-Flop Coasters;" http://www.gotmartini.com/MartiniCoasters.htm; downloaded from internet May 13, 2010 (6 pages).

www.forquiltssake.com; "Wine Glass Coasters;" http://www.forquiltssake.com/WineGlassCoasters.htm; downloaded from from internet May 13, 2010 (3 pages).

www.ehow.com; "How to Sew Wine Glass Coasters;" http://www.ehow.com/how_5045429_sew-wine-glass-coasters.html; Jun. 2009; (6 pages).

* cited by examiner

*Primary Examiner* — Todd M. Epps
(74) *Attorney, Agent, or Firm* — Peter J. Mikesell; Hiscock & Barclay, LLP

(57) ABSTRACT

Disclosed in this specification is a coaster for stemmed glassware that has three sections joined together. The bottom section is circular and is attached to two curved top sections. The top sections are raised to form a pocket for receiving the base of the stemmed glassware. The curved inner edges of the top sections permit ease of attachment of the glass in a variety of ways.

18 Claims, 12 Drawing Sheets

CIRCULAR COASTER FOR STEMMED GLASS

CROSS-REFERENCE TO RELATED APPLICATIONS

This application claims priority to and the benefit of U.S. provisional patent application Ser. No. 61/347,105, filed May 21, 2010, which application is incorporated herein by reference in its entirety.

FIELD OF THE INVENTION

This invention relates, in one embodiment, to a coaster for stemmed glassware, including wine glasses, champagne flutes and the like.

BACKGROUND

Coasters are used to permit the user to place glassware on a surface and avoid wetting and potentially damaging the surface. Conventionally, coasters are placed near the surface to be protected for use by the drinker. However, in social settings where a person moves about, a coaster may not always be available.

Additionally, at these social settings, it may be desirable for a coaster to have a pleasing appearance. Prior art coasters have been developed that have the appearance of novelty items (e.g. shoes and the like). Unfortunately, these coasters have a tendency to slip from the base of the glass. Additionally, these prior art coasters typically have only one method for attachment to the glass and the user is accordingly limited.

There is therefore a need for an improved coaster for stemmed glassware.

SUMMARY OF THE INVENTION

The invention comprises, in one form thereof, a coaster for stemmed glasses that has a circular bottom section and two top sections. The top sections have curved inner and outer edges that meet at respective points. Three of the points are attached to the edge of the bottom section. The fourth point is disposed under the top section and is unsecured thereby functioning as a flap.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION OF A PREFERRED EMBODIMENT

Figure 1:
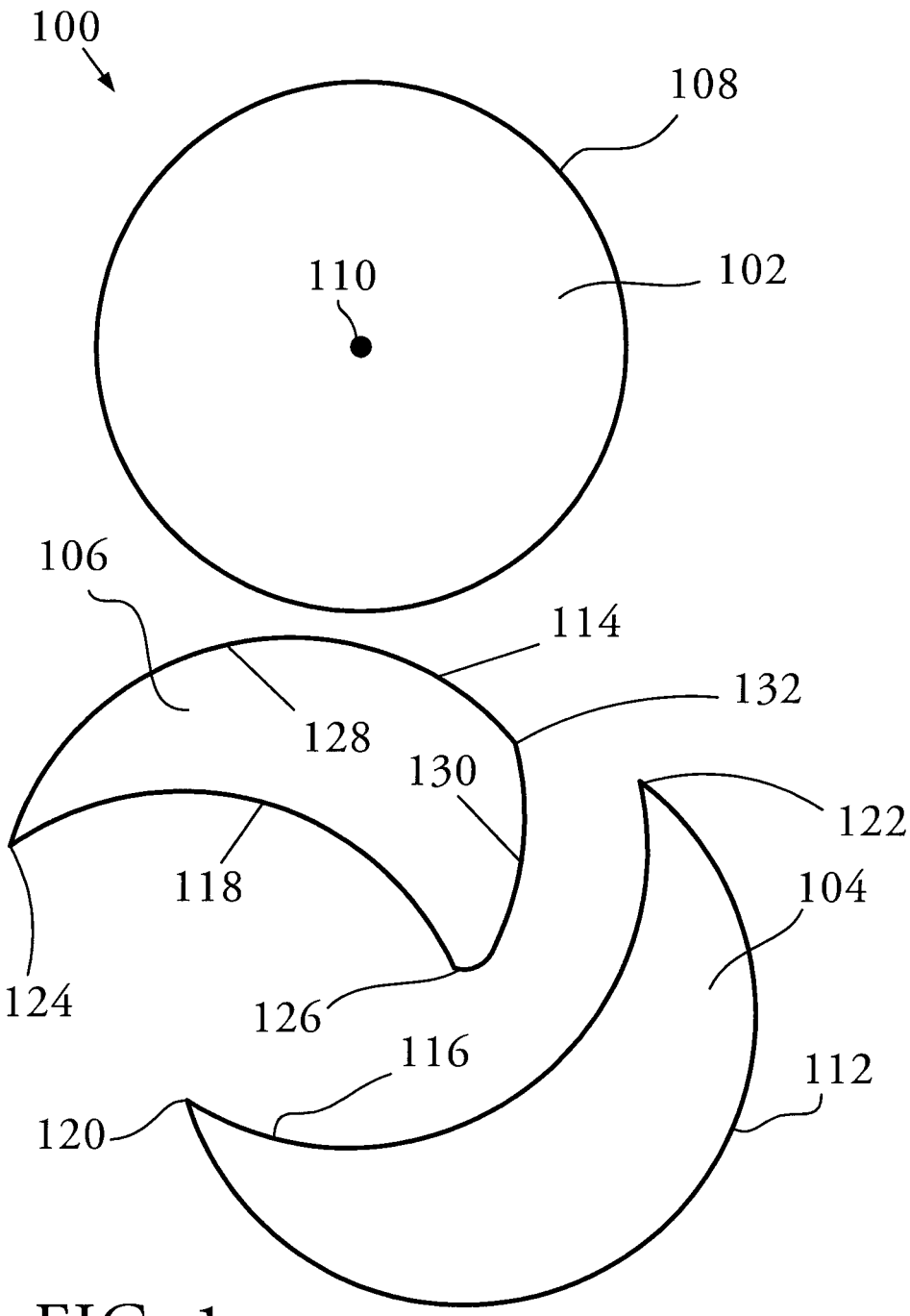
FIG. 1 is a depiction of three sections used to make a coaster of the invention.

Referring to FIG. 1, coaster 100 is shown in a disassembled state. The coaster is formed from three separate sections including circular bottom section 102, first top section 104 and second top section 106. Bottom section 102 has a circular edge 108 centered about center point 110. First and second top sections 104, 106 have first and second curved outer edges 112, 114 and first and second curved inner edges 116, 118. Each inner edge meets the corresponding outer edge at two points. For example, the inner and outer edges 112, 116 of first top section 104 meet at point first 120 and second point 122. Likewise, the inner and outer edges 114, 118 of second top section 106 meet at third point 124 and fourth point 126. The first top section is crescent-shaped and consists of two edges, 112 and 116, each of which has its own curvature which is uniform over the entire edge. The second top section is pseudo-crescent-shaped and consists of inner edge 118 and outer edge 114. Inner edge 118 consists of a single portion which has a uniform curvature over its entire edge. Outer edge 114 consists of two portions: a first portion 128 with a first curvature and a second portion 130 with a second, different curvature. The curvature of the first and second portions changed at fifth point 132.

Figure 2:
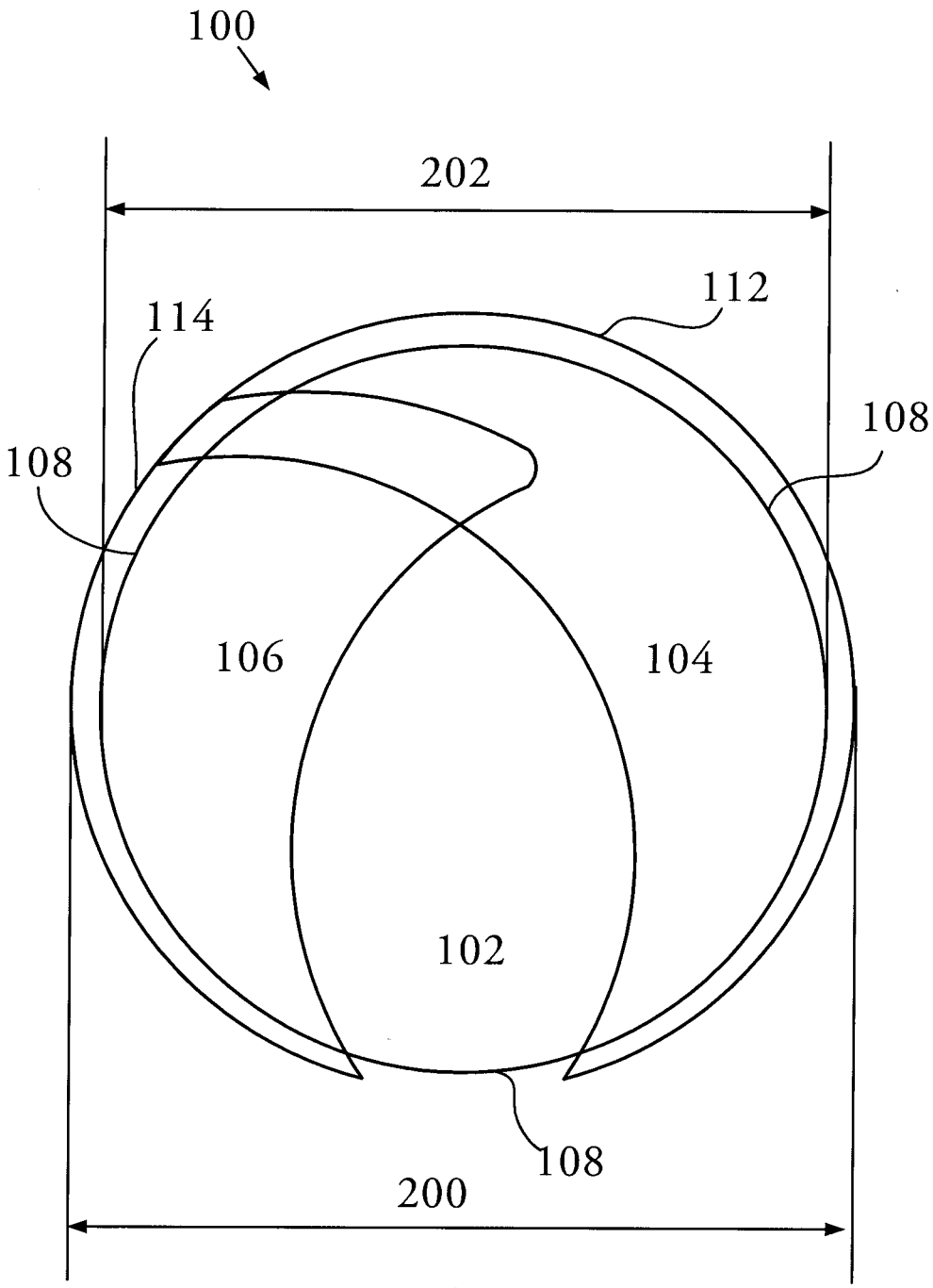
FIG. 2 illustrates the relative sizes of the three sections and their approximate positioning.
Figure 3:
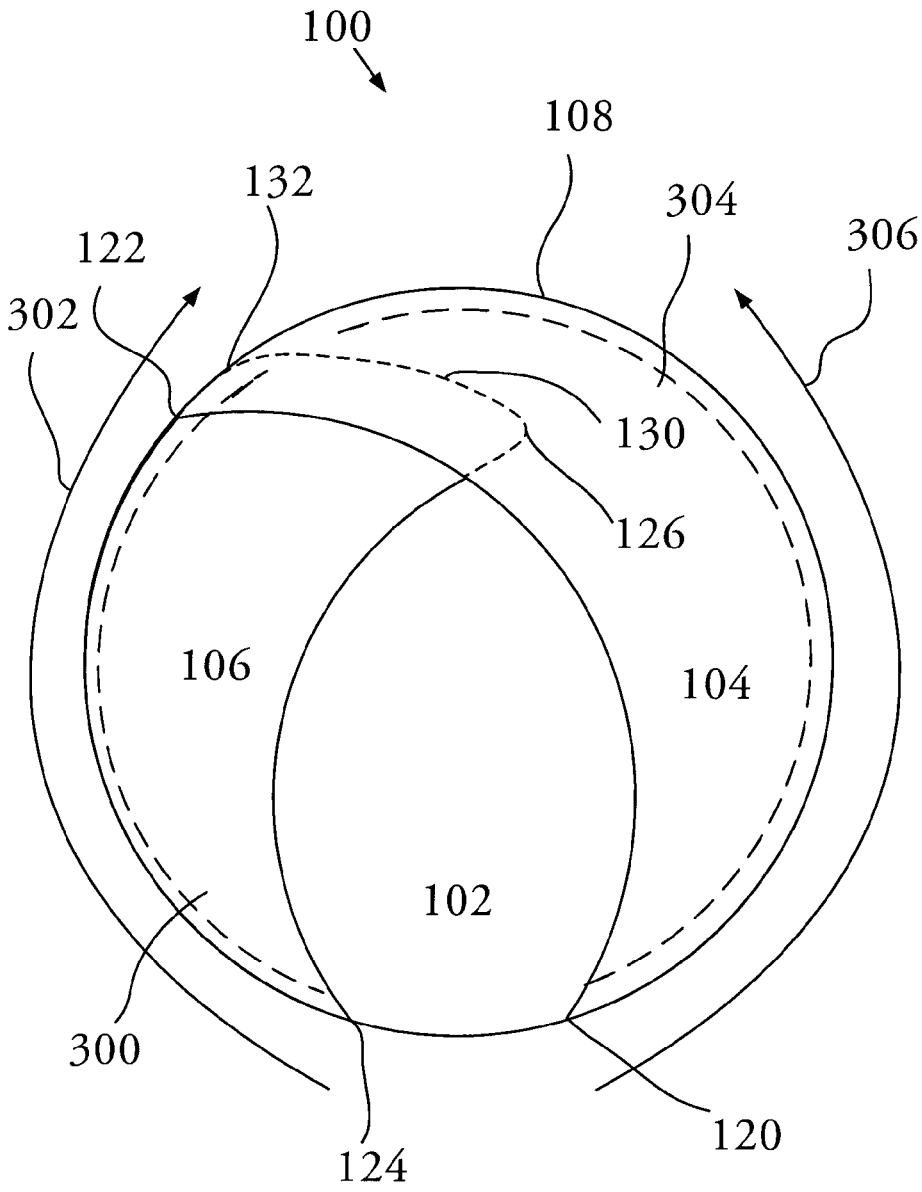
FIG. 3 schematically depicts the assembled coaster.

Referring now to FIG. 2, the coaster 100 is shown in a partially assembled state. In the embodiment of FIG. 2, the bottom section and the first and second top sections have not been jointed. FIG. 2 depicts the relative size of bottom section 102 and first and second top sections 104, 106. First and second top sections are oversized, relative to bottom section 102, such that the diameter 200 established by the two top sections is larger than the diameter 202 of the bottom section. When top section 104 is disposed above bottom section 102, the first outer edge 112 covers a section of the circular edge 108 of the bottom section. Likewise, when top section 106 is disposed above bottom section 102, the second outer edge 114 covers a section the circular edge 108 of the bottom section. As shown in FIG. 3, when the top sections are joined to the bottom section, the oversized nature of the top section will produce a pocket in the fully assembled coaster.

FIG. 3 depicts coaster 100 in an assembled state. During assembly second top section 106 is disposed atop bottom section 102 such that their outer edges (108, 114, see FIG. 2) are in contact. Seam 300 is sewn, preferably in the direction of arrow 302. Thereafter, first top section 104 is disposed atop bottom section 102 such that their outer edges (108, 112, see FIG. 2) are in contact. Seam 304 is sewn, preferably in the direction of arrow 306. First, second, third and fifth points 120, 122, 124 and 132 are on, and secured to, the circular edge 108 of bottom section 102. Fourth point 126 is unsecured from both the bottom section 102 and first top section 104 and is free to function as a flap.

Figure 4A:
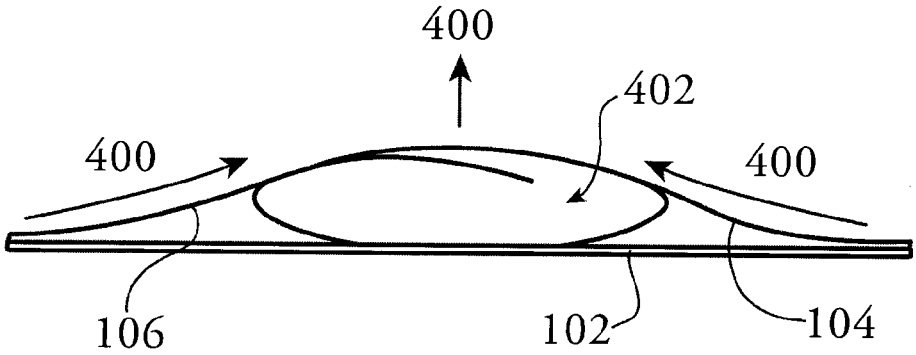
FIGS. 4A and 4B are illustrates of the raised pocket of the assembled coaster.
Figure 4B:
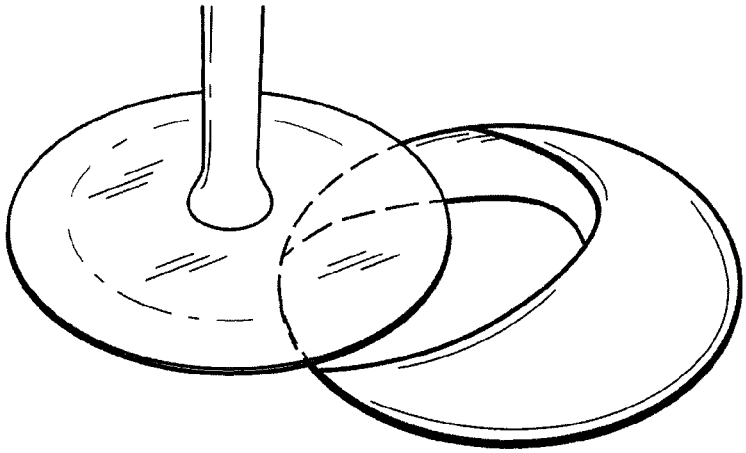

As shown in FIG. 4A and FIG. 4B, and with reference to FIG. 1, when the oversized top sections are secured to the bottom section such that the outer edges 112 and portion 128 of edge 114 contact the edge 108 of the circular bottom section, this forces the two top sections to raise upwards in the direction of arrows 400 and form pocket 402. The inner edges 116 and 118 of the coaster gradually curve upwards and away from the bottom section 102 as one moves toward center point 110. This bunched pocket provides an area for receiving the base of a stemmed glass. See FIG. 4B.

Figure 5A:
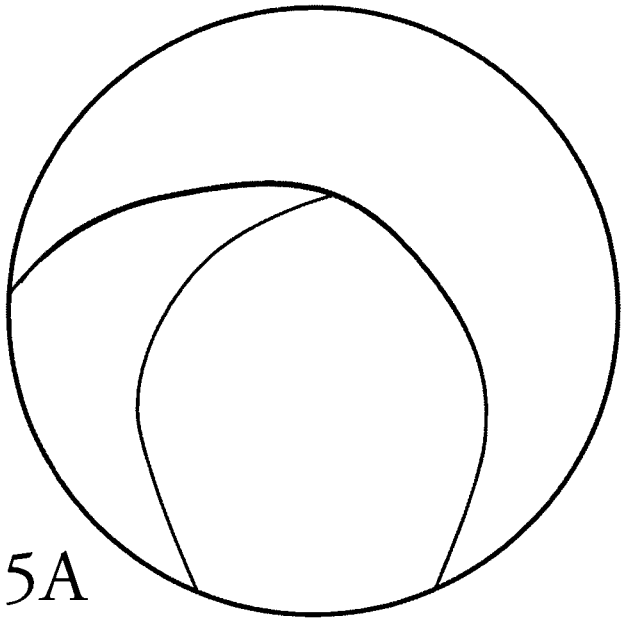
FIGS. 5A and 5B are top and bottom views, respectively, of the assembled coaster.
Figure 5B:
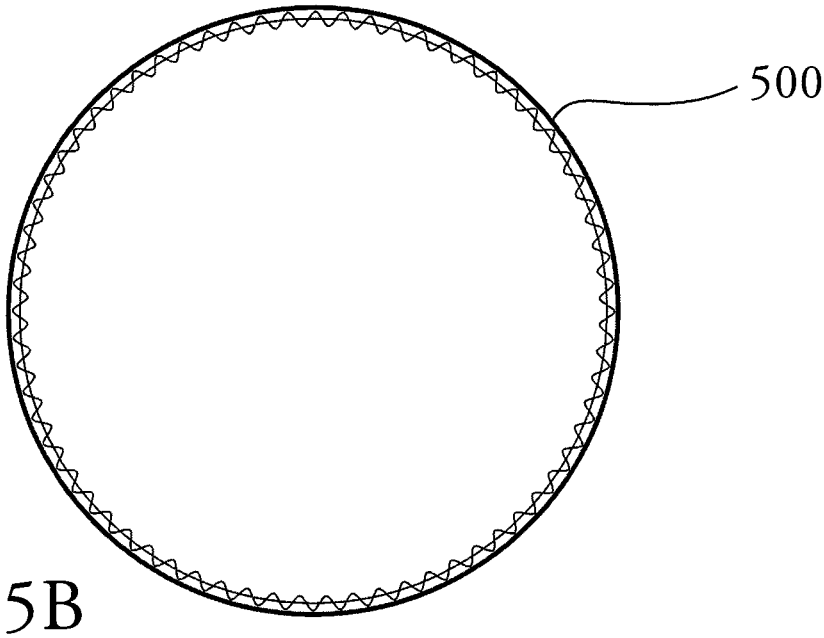

FIG. 5A depicts a top view of the assembled coaster 100. FIG. 5B depicts of bottom view of the same coaster. Note that, in the embodiment of FIG. 5B, stitching 500 circumscribes the entire circumference of bottom section 102. Stitching 500 includes stitching 300 and 304 of FIG. 3. In other embodiments, not shown, that portion of the edge 108 of the bottom section that is not in contact with the outer edges of either top section is not stitched.

Figure 6A:
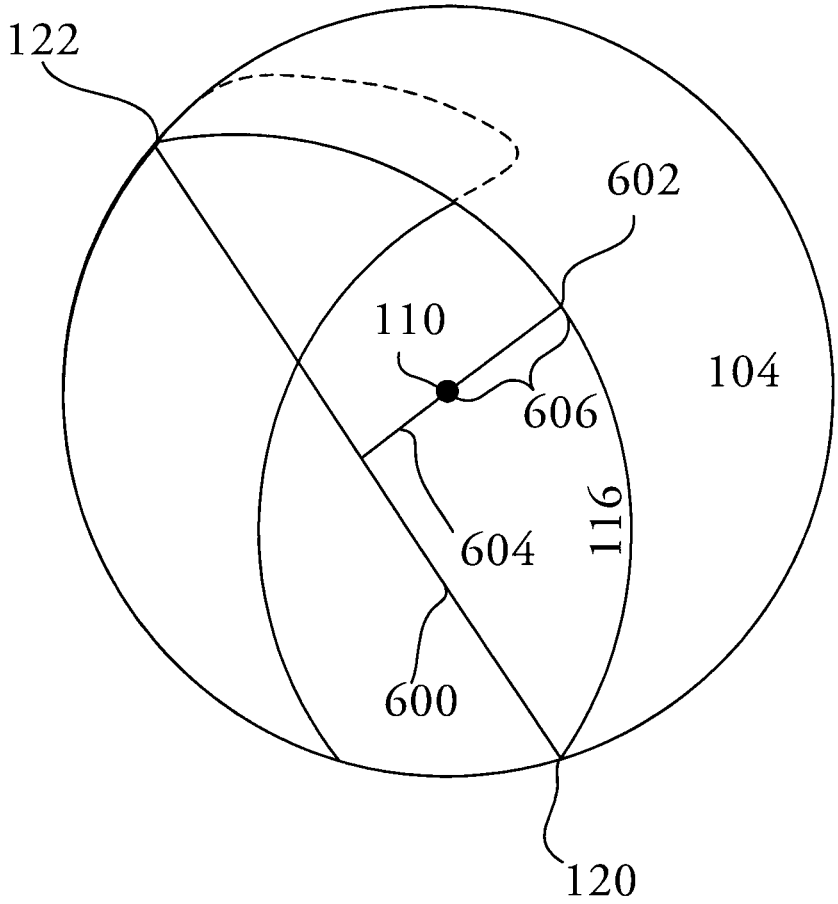
FIG. 6A depicts the configuration of the inner curved edge of the first top section.

FIG. 6A is a depiction of various mechanical and geometric features of illustrated coaster. First point 120 and second point 122 are separated by imaginary line 600. Imaginary line 600 is bisected by imaginary line 604 which passes through both the midpoint 602 of the first curved inner edge 116 and center point 110. The midpoint 602 is offset from the center point 110 by distance 606.

Figure 6D:
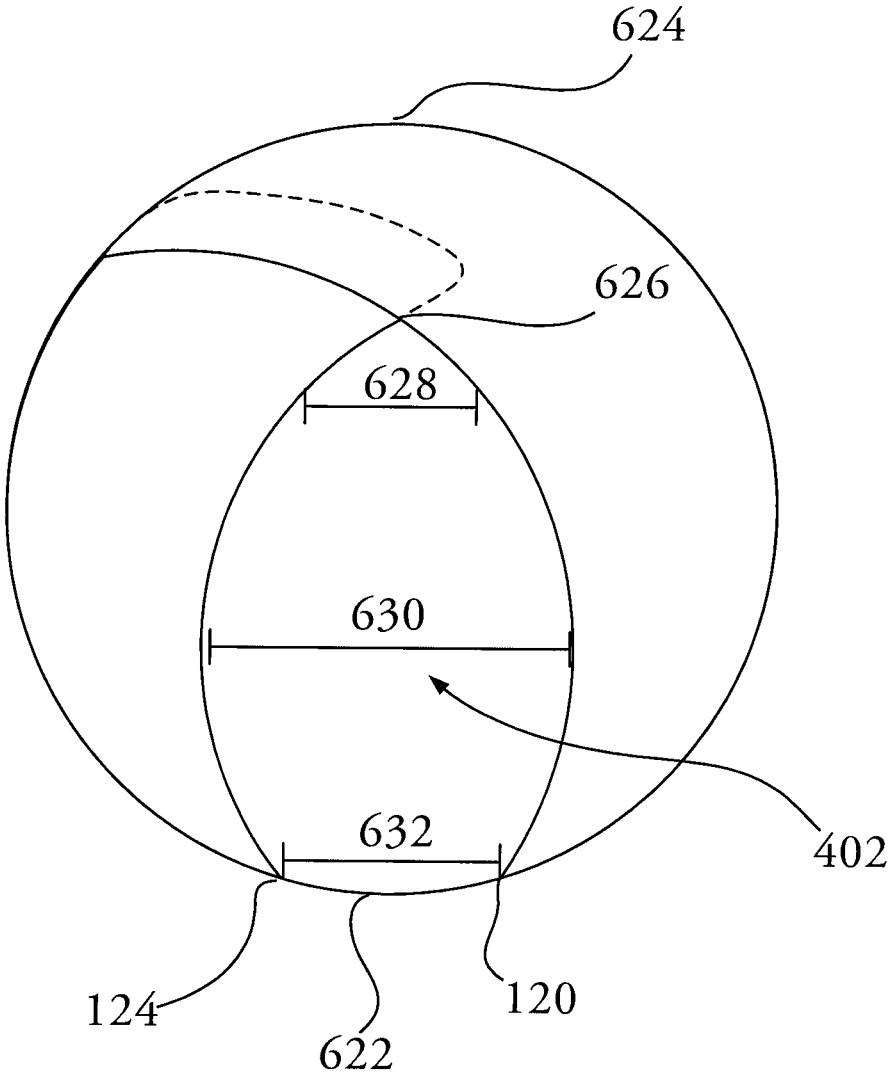
FIG. 6D shows a top view of the pocket width.
Figure 6B:
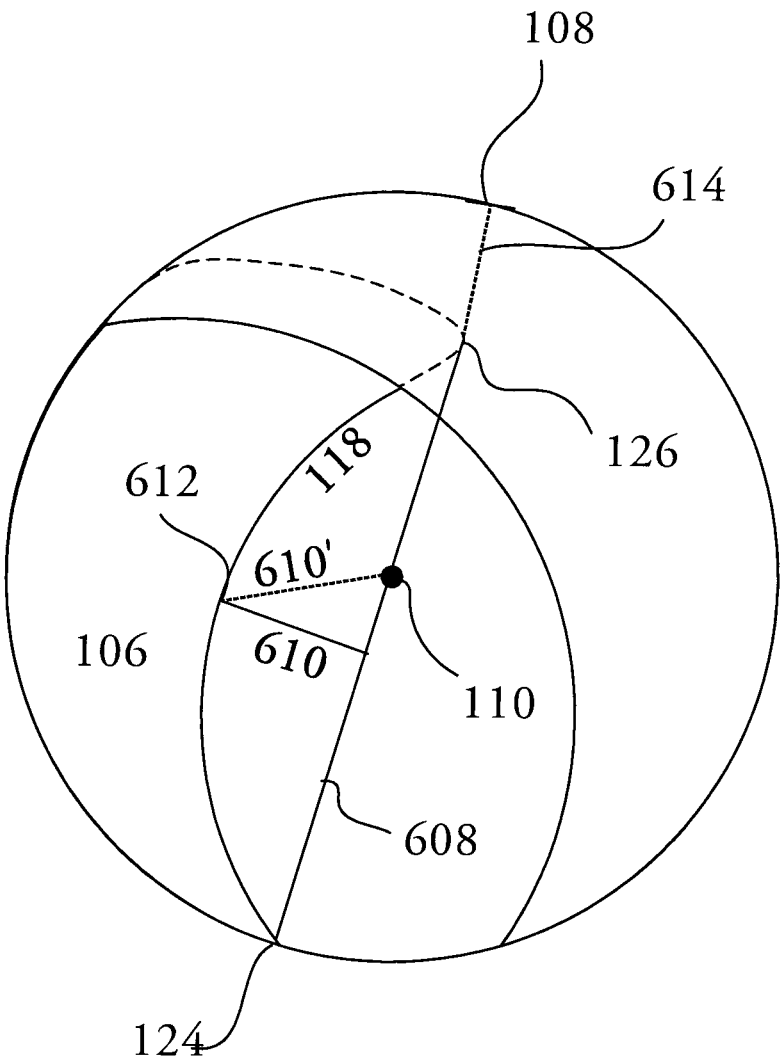
FIG. 6B depicts the configuration of the inner curved edge of the second top section.

FIG. 6B depicts third point 124 and fourth point 126 which are separated by imaginary line 608. Imaginary line 608 is bisected by imaginary line 610 which passes through midpoint 612 of inner edge 118 but does not pass through center point 110. Line 610 does not pass through center point 110 because fourth point 126 is separated from the circular edge 108 by distance 614. The midpoint 612 is offset from the center point 110 by distance 610'.

Figure 6C:
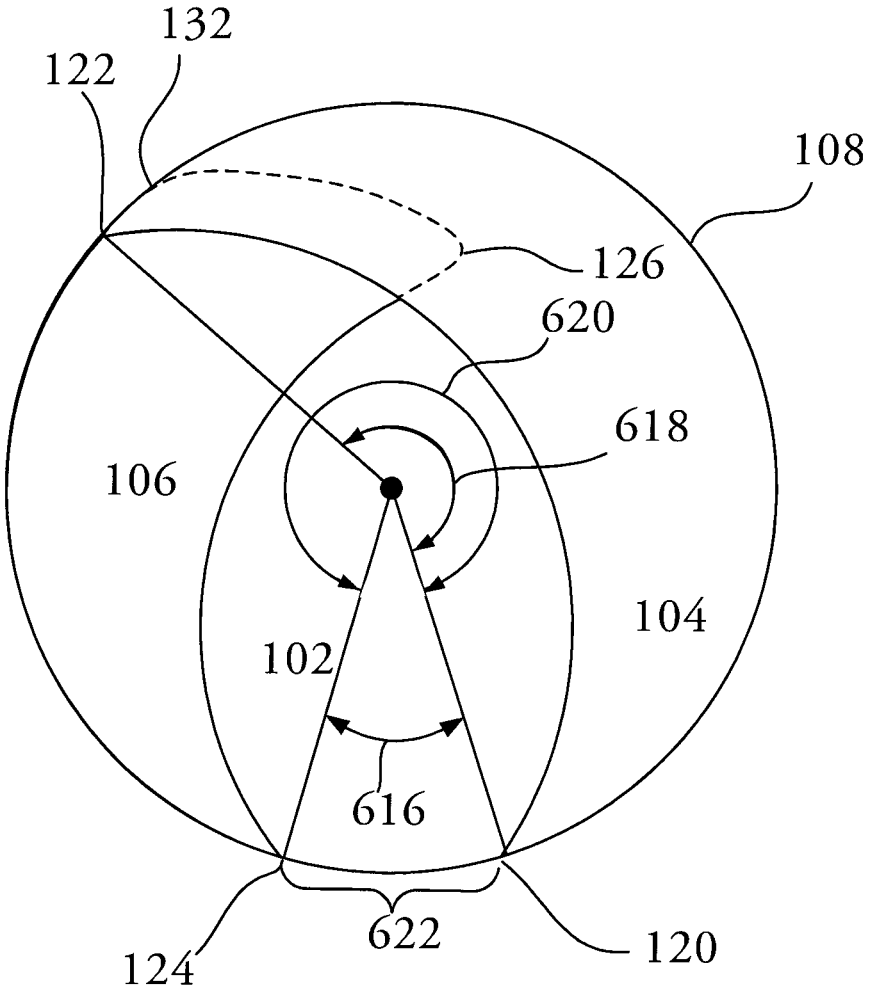
FIG. 6C illustrates various geometric angles associated with the illustrated coaster.

FIG. 6C illustrates various geometric angles of the depicted coaster. The first curved outer edge (112, see FIG. 1) of the first top section 104 contacts the edge 108 of the bottom section over an angle 618. In one embodiment, this angle is at least two hundred degrees. In another embodiment angle 618 is about two hundred forty degrees. In one embodiment, angle 618 is less than about two hundred seventy degrees. The first and second curved outer edges (112 and 114, see FIG. 1) of first and second top sections 104 and 106 collectively contact the edge 108 of the bottom section over an angle 620. In one embodiment, angle 620 is at least three hundred degrees. In another embodiment, angle 620 is about three hundred fifteen degrees. In one embodiment, angle 620 is less than about three hundred twenty five degrees. The bottom section 102 has an exposed front 622 which does not contact either the first or second top sections 104 and 106. The width of front 622 is determined by angle 616. In one embodiment, angle 616 is at least thirty five degrees. In another embodiment, angle 616 is about forty five degrees. In one embodiment, angle 616 is less than ninety degrees.

FIG. 6D depicts pocket 402 from the top of coaster 100. The coaster includes front 622 and back 624 which is opposite front 622. The curved inner edges of the two top sections intersect at point 626. The pocket, when viewed from above, is narrower near the back 624 and front 622 than in the middle of the pocket. For example, the distance 628 at the back and the distance 632 at the front are less than the distance 630 which is between the back and the front.

Figure 7A:
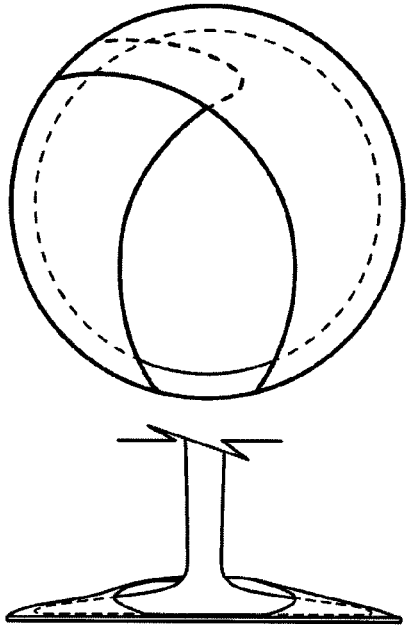
FIGS. 7A-7D show one method for using the coaster.
Figure 7B:
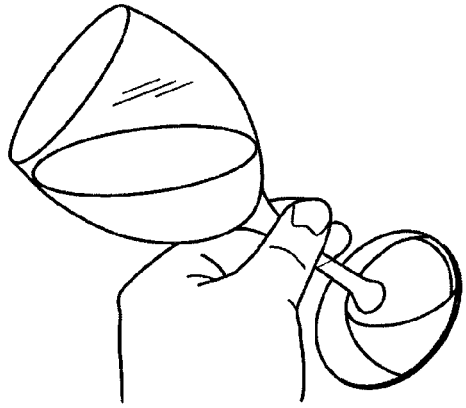
Figure 7C:
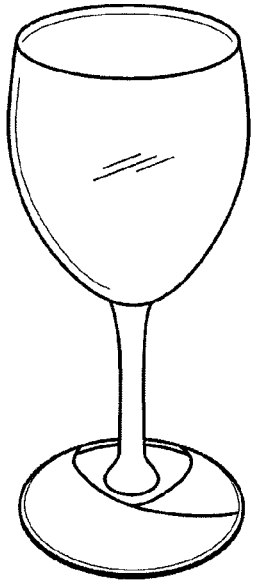
Figure 7D:
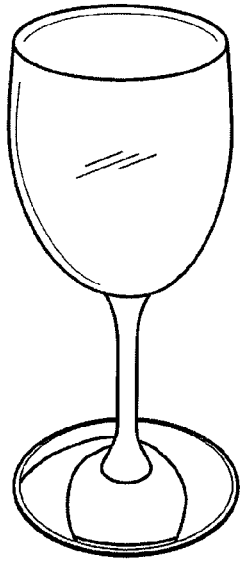

FIGS. 7A, 7B, 7C and 7D illustrate one method for using the coaster 100. In the depicted embodiment, the base of the glass is disposed above the bottom section, but beneath both the first and second top sections. As shown in FIG. 7B, the coaster remains securely fastened to the glass, even when the glass is tipped.

Figure 8A:
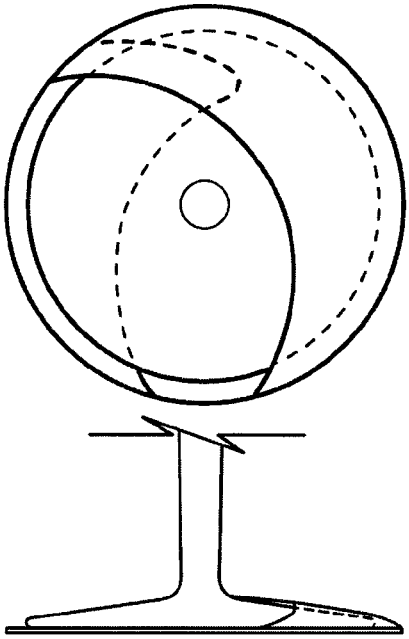
FIGS. 8A-8D show another method for using the coaster.
Figure 8B:
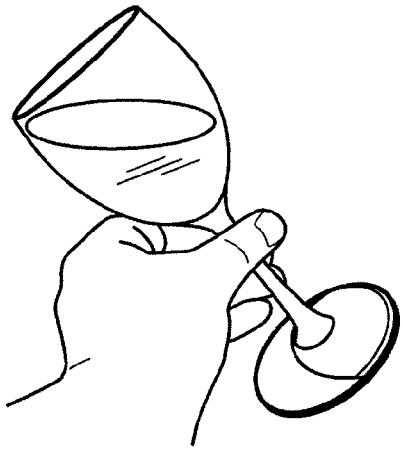
Figure 8C:
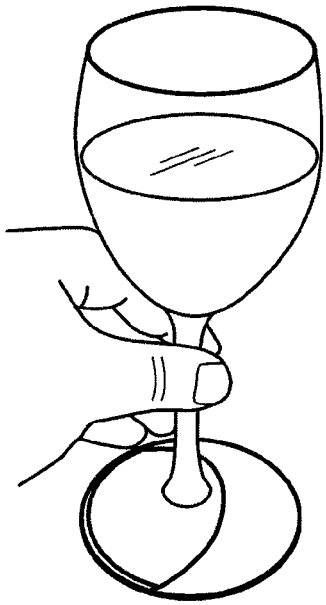
Figure 8D:
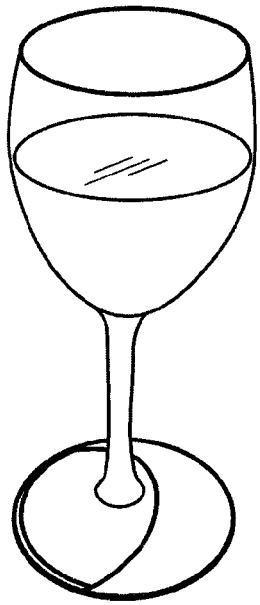

FIGS. 8A, 8B, 8C and 8D illustrate another method for using the coaster 100. In the depicted embodiment, the base of the glass is disposed above the bottom section and the second top section, but beneath the first top section. As shown in FIG. 8B, the coaster remains securely fastened to the glass, even when the glass is tipped.

Figure 9A:
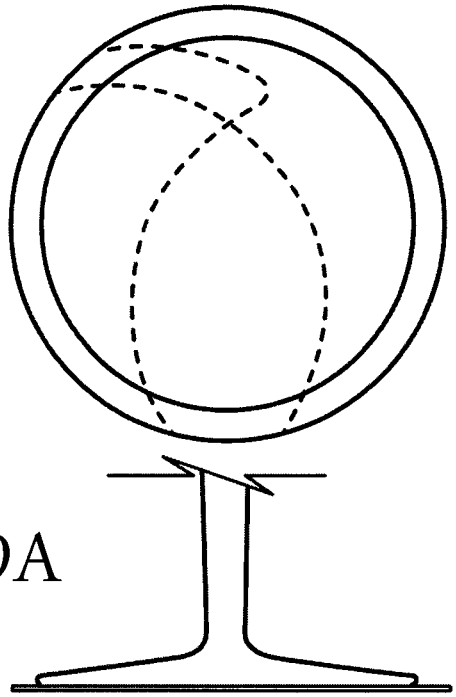
FIGS. 9A and 9B show yet another method for using the coaster.
Figure 9B:
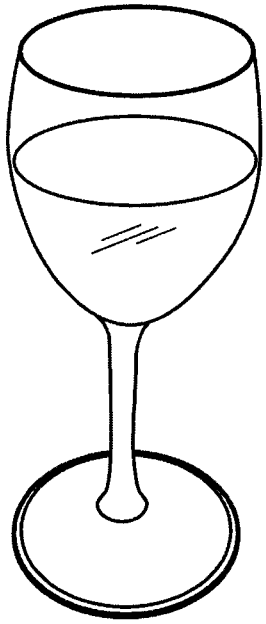

FIGS. 9A and 9B illustrate another method for using the coaster 100. In the depicted embodiment, the base of the glass is disposed above the bottom section as well as the first and second top sections.

The bottom sections and two top sections may be formed of any suitable material. Examples of such materials include leather, synthetic leather, fabrics, disposable textile materials and disposable paper materials. Decorative patterns may also be applied to the coaster (e.g. floral patterns, holiday images, stripes, names, words or phrases, logos, or other geometrical or festive displays).

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A circular coaster for stemmed glasses comprising:

a circular bottom section with a circular edge and a center point;

a first top section with a first curved inner edge and a first curved outer edge, each such edge meeting the other at first and second points, the first top section being positioned above the circular bottom section such that the first and second points as well as the first curved outer edge are on the circular edge of the bottom section;

a second top section with a second curved inner edge and a second curved outer edge, each such edge meeting the other at third and fourth points, the second top section being positioned on the circular bottom section such that the third point is on the circular edge of the bottom section while the fourth point is distal from the circular edge of the bottom section and beneath the first top section;

the first, second and third points being secured to the bottom section while the fourth point is disposed beneath the first top section and is unsecured from both the bottom section and the first top section.

2. The circular coaster as recited in claim 1, wherein the first curved outer edge contacts the circular edge of the bottom section over an angle of at least two hundred degrees and the first curved inner edge has a midpoint that is offset from the center point of the bottom section.

3. The circular coaster as recited in claim 1, wherein the first curved outer edge contacts the circular edge of the bottom section over an angle of about two hundred forty degrees.

4. The circular coaster as recited in claim 1, wherein the first curved outer edge and the second curved outer edge collectively contact the circular edge of the bottom section over an angle of at least three hundred degrees.

5. The circular coaster as recited in claim 1, wherein the first curved outer edge and the second curved outer edge collectively contact the circular edge of the bottom section over an angle of about three hundred fifteen degrees.

6. The circular coaster as recited in claim 1, wherein the first curved outer edge and the second curved outer edge collectively contact the circular edge of the bottom section over an angle of at least three hundred degrees while leaving a portion of the circular edge of the bottom section exposed over an angle of at least thirty five degrees.

7. The circular coaster as recited in claim 1, wherein the first curved outer edge and the second curved outer edge collectively contact the circular edge of the bottom section over an angle of about three hundred fifteen degrees while leaving a portion of the circular edge of the bottom section exposed over an angle of about forty five degrees.

8. The circular coaster as recited in claim 1, wherein the first curved outer edge and the second curved outer edge collectively contact the circular edge of the bottom section over an angle of about three hundred fifteen degrees while leaving a portion of the circular edge of the bottom section exposed over an angle of about forty five degrees and the first and second curved inner edges each have respective midpoints that are offset from the center point of the bottom section.

9. The circular coaster as recited in claim 1, wherein the second curved outer edge includes a first portion secured to the circular edge of the bottom section and a second portion, unsecured to the circular edge of the bottom section and disposed beneath the first top section, the first curved outer edge's entire length also being secured to the circular edge of the bottom section.

10. The circular coaster as recited in claim 9, wherein the first and second curved outer edge are oversized relative to the circular edge of the bottom section, thereby providing a raised pocket for receiving a base of a glass.

11. The circular coaster recited in claim 1, wherein the first top section has a crescent shape.

12. A circular coaster for stemmed glasses comprising:

a circular bottom section with a circular edge and a center point;

a first top section with a first curved inner edge and a first curved outer edge, each such edge meeting the other at first and second points, the first top section being positioned above the circular bottom section such that the first and second points as well as the first curved outer edge are on the circular edge of the bottom section;

a second top section with a second curved inner edge and a second curved outer edge, each such edge meeting the other at third and fourth points, the second curved outer edge including a first portion and second portion that meet at a fifth point, the second top section being positioned on the circular bottom section such that the third point and fifth points on the circular edge of the bottom section while the fourth point is distal from the circular edge of the bottom section and beneath the first top section;

the first, second, third and fifth points being secured to the bottom section while the fourth point and second portion are disposed beneath the first top section and are unsecured from both the bottom section and the first top section;

wherein the first curved outer edge and the second curved outer edge collectively contact the circular edge of the bottom section over an angle of at least three hundred degrees while leaving a portion of the circular edge of the bottom section exposed over an angle of at least thirty five degrees and the first and second curved inner edges each have respective midpoints that are offset from the center point of the bottom section and the first and second curved outer edge are oversized relative to the circular edge of the bottom section, thereby providing a raised pocket for receiving a base of a glass.

13. The circular coaster recited in claim 12, wherein the first curved outer edge and the second curved outer edge collectively contact the circular edge of the bottom section over an angle of about three hundred fifteen degrees while leaving a portion of the circular edge of the bottom section exposed over an angle of about forty five degrees.

14. The circular coaster as recited in claim 12, wherein the first curved outer edge's entire length and a portion, but not all, of the second curved outer edge's length are secured to the circular edge of the bottom section.

15. A method of securing a coaster to a stemmed drinking container comprising the steps of:

providing a coaster as recited in claim 1;

providing a stemmed drinking container with a base; and disposing the base above the bottom section but beneath the first and second top sections, thereby securing the coaster to the base.

16. A method of securing a coaster to a stemmed drinking container comprising the steps of:

providing a coaster as recited in claim 1;

providing a stemmed drinking container with a base; and disposing the base above both the bottom section and the second top section, but beneath the first top section, thereby securing the coaster to the base.

17. A method of securing a coaster to a stemmed drinking container comprising the steps of:

providing a coaster as recited in claim 12;

providing a stemmed drinking container with a base; and disposing the base above the bottom section but beneath the first and second top sections, thereby securing the coaster to the base.

18. A method of securing a coaster to a stemmed drinking container comprising the steps of:

providing a coaster as recited in claim 12;

providing a stemmed drinking container with a base; and disposing the base above both the bottom section and the second top section, but beneath the first top section, thereby securing the coaster to the base.

* * * * *